United States Patent [19]

Stoltz

[11] 4,216,790

[45] Aug. 12, 1980

Best Available Copy

[54] STORM DRAINAGE SYSTEMS

[75] Inventor: Richard J. Stoltz, Bramalea, Canada

[73] Assignee: R. J. Stoltz Enterprises Inc., Bramalea, Canada

[21] Appl. No.: 964,247

[22] Filed: Nov. 27, 1978

[51] Int. Cl.[3] ..... E03F 3/00

[52] U.S. Cl. ..... 137/357; 52/12; 52/16; 210/163

[58] Field of Search ..... 52/12, 16; 137/357; 210/163

[56] References Cited

U.S. PATENT DOCUMENTS

| | | | |
|---|---|---|---|
| 550,032 | 11/1895 | Tucker | 210/163 |
| 1,011,669 | 12/1911 | Temme | 52/12 X |
| 1,862,134 | 6/1932 | Boosey | 210/163 |
| 1,973,321 | 9/1934 | Schultz | 210/163 |
| 2,121,613 | 6/1938 | Schultz | 210/163 |
| 2,640,593 | 6/1953 | Korb | 52/12 X |
| 3,357,561 | 12/1967 | Schmid et al. | 52/12 X |
| 3,409,138 | 11/1968 | Lawrence | 52/12 X |
| 3,469,698 | 9/1969 | Blendermann | 52/12 X |
| 3,967,452 | 7/1976 | Maloney, Jr. et al. | 52/16 X |
| 4,150,683 | 4/1979 | Simon | 137/1 |

*Primary Examiner*—Gerald A. Michalsky

*Attorney, Agent, or Firm*—Fetherstonhaugh & Co.

[57] ABSTRACT

A storm drainage system and a device for use in the system for restricting the rate at which water drains from an eavestrough is disclosed hereinafter. The storm drainage system includes a plurality of pitched roofed structures, a sewer service connection associated with each structure, a municipal sewer drainage system in direct fluid communication with the sewer service connection, an eavestrough system associated with each pitched roofed structure for collecting runoff therefrom and at least one downspout associated with each eavestrough system. The downspout has a through passage for conveying runoff water from its associated eavestrough to the sewer service connection. A flow restricting device is located in the through passage for restricting the flow of water through the through passage to a flow which is substantially less than the unrestricted flow capacity of the downspout whereby the rate at which water is conveyed to the municipal sewer drainage system in storm conditions is limited to that which the sewer drainage system can accommodate from each pitched roofed structure. The flow restricting device includes a cover proportioned to fit within the eavestrough and adapted to be mounted in a position overlying the input end of the downspout. A drainage passage opens through the cover to permit water to pass therethrough. The drainage passage is proportioned to permit a restricted flow of water from the eavestrough to the downspout in use thereby to achieve the required flow restriction.

8 Claims, 4 Drawing Figures

FIG. 4
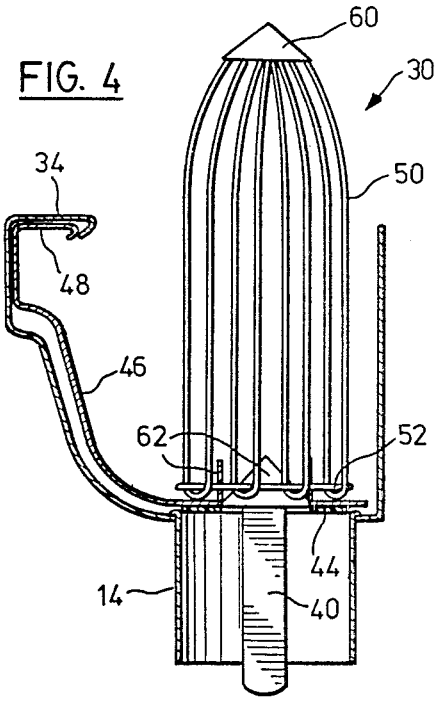
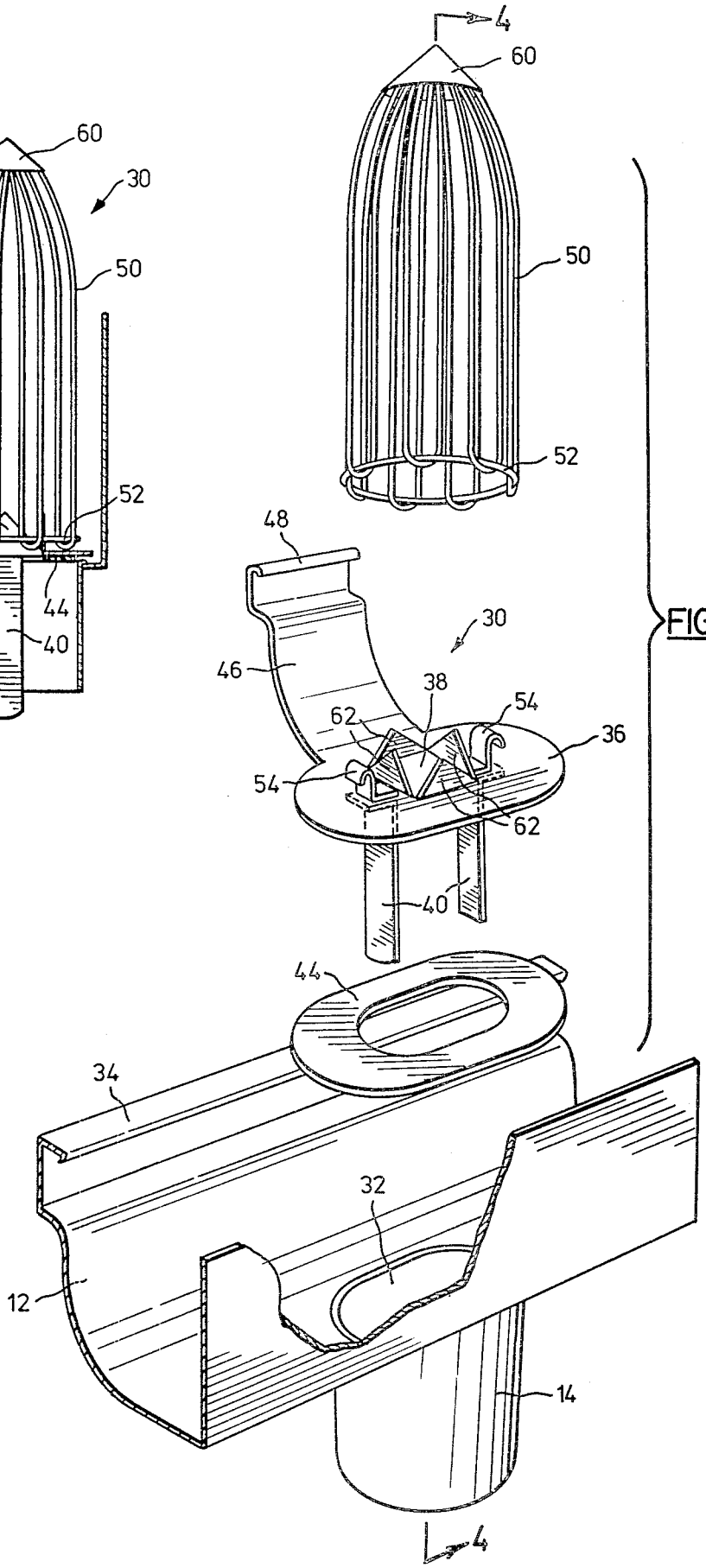
FIG. 3

STORM DRAINAGE SYSTEMS

FIELD OF INVENTION

This invention relates to improvements in storm drainage systems. Particularly, this invention relates to improvements in storm drainage systems which will prevent excessive run off of water from a pitched roofed structure to a public, municipal sewer drainage system.

PRIOR ART

Traditionally, municipal sewer drainage systems used for draining water from roofed structures are designed to convey the water from a plurality of pitched roofed structures to the municipal storm sewer system as quickly as possible. This is achieved by providing eavestroughs which collect the water draining from its associated pitched roofed structure and conveying the water to down spouts which are in turn directly connected to the sewer service connection which is in turn directly connected to the main municipal sewer drainage system. Also connected to the sewer service connection is the foundation drainage system of the roofed structure. Many older municipalities have "combined" municipal sewer drainage systems i.e. sewers that convey both storm sewage and domestic sanitary wastes in a single conduit. In such cases, the downspouts, the foundation drains, and the internal domestic plumbing of the roofed structure is directly connected to a single service connection which in turn is directly connected to the combined municipal sewer drainage system. Hereinafter the term municipal sewer drainage system will be employed to identify both the separate and combined systems discussed above.

The eavestroughs and downspout are proportioned to standard sizes which have been developed over many years which are considered adequate for the purposes of receiving and channeling all of the rain water which might be expected in the most severe of rain storms known to the particular geographical area of the installation. The proportions of the eavestrough and downspout are traditionally selected so as to avoid a situation where a rain storm is likely to cause the eavestroughs to overflow to discharge water directly onto the ground surrounding the roofed structure. Thus, the objective in selecting the proportions of the eavestroughs and downspout is to prevent overflow of the eavestrough in a predetermined storm condition.

Heretofore, it has been common to design the municipal sewer drainage systems, into which drain the downspouts, the foundation drains and in the case of combined sewers, the domestic plumbing, to accommodate the runoff from relatively low frequency rainfall storms such as a storm that would occur on the average at least once every 2 years i.e. a two year storm, the two year storm capacity being determined statistically from records relating to storms in the selected geographical area. More recently there has been a tendency to design municpal storm sewer drainage systems to accommodate a five year storm and in some areas municipal storm sewer systems are designed to accommodate a ten year storm. In any such system it is accpeted that periodically rain conditions will be such that the municipal sewer drainage system will be overloaded by runoff produced by storms that are in excess of the design storm. A major contributor of the problem is the downspouts which are fed by the roof drainage systems. For practical purposes of cost and efficiency a limit must be applied to the carrying capacity of the municipal storm sewer drainage systems. Thus a solution to overloading of the municipal storm sewer drainage system does not lie in the provision of ever increasing capacity.

One of the problems which results from overloading of the municipal sewer drainage system is that water in the system will back up into the sewer service connection and into the foundation drains usually with enough hydrostatic pressure to crack basement floors, causing severe structural damage and flooding of the basement areas of the roofed buildings. When combined sewers are overloaded, combined sewage consisting of storm sewage and domestic sewage will back up into the service connection and again not only into the foundation drains, but into the plumbing of the pitched roofed structure and will enter the basement of the roofed building via the basement floor drain.

Despite the fact that the separation of the sanitary sewage from storm sewage does not totally overcome the flood problems associated with municipal sewage systems, many municipalities are, on the advice of experts in the field, actively planning to convert existing combined systems to separate systems. The problems associated with the flooding of sewage systems which carry sanitary waste are so great that many municipalities are prepared to accept the high costs involved in separating the systems. I have found that I can obtain substantially the same result and in some instances a superior result to that which can be obtained by separating the systems merely by a simple modification to the existing system at a fraction of the cost involved in converting the system.

I have discovered that the problems relating to overloading of municipal sewer drainage systems can be substantially and dramatically reduced without the necessity of providing an ever increasing capacity in new systems and without requiring enlargement of the carrying capacity of existing municipal sewer drainage systems.

This improvement is achieved by the simple expedient of providing a flow restricting device for restricting the flow of water from an eavestrough to its associated downspout thereby to limit the rate at which water can be conveyed from the roofed structure to its sewer service connection. As a consequence of reducing the rate at which water is transmitted directly to the downspout thereby to the sewer service connection there is an increased likelihood that the eavestroughs will be flooded in severe storm conditions. I found that the spilling of water from the eavestrough onto the ground surrounding the building results in less costly damage to the pitched roofed structure and its surrounding than that commonly caused by overloading of the municipal sewer drainage system which as previously indicated frequently results in flooding and structural damage of basements and the like.

SUMMARY OF THE INVENTION

According to one aspect of the present invention, there is provided a device for restricting the rate at which water drains from an eavestrough into a downspout, the downspout having an input end opening into the base of its associated eavestrough, said device comprising a cover plate proportioned to fit within said eavestrough and to extend in an overlying relationship with respect to and substantially cover the input end of said downspout to prevent full flow discharge of water from said eavestrough to said downspout, mounting means associated with said cover plate for retaining said cover plate in an overlying relationship with respect to the input end of said downspout in use, a drainage passage opening through said cover plate to permit water to pass therethrough, said drainage passage being proportioned to permit restricted flow of water from said eavestrough to said downspout in use, said drainage passage having a cross-sectional area which is substantially less than that of the input end of said downspout in association with which it is to be used such that said restricted flow is substantially less than said full flow thereby to effect a substantial reduction in the rate of runoff from the eavestrough to its associated downspout.

According to a further aspect of the present invention, there is provided a storm drainage system which comprises resilient sealing means disposed between said cover plates and its underlying eavestrough.

According to yet another aspect of the present invention, there is provided a storm drainage system which comprises a plurality of pitched roofed structures, a sewer service connection associated with each pitched roofed structure, a municipal sewer drainage system in direct fluid communication with said sewer service connection, an eavestrough system associated with each pitched roofed structure for collecting run off water therefrom, at least one downspout associated with each eavestrough system, each downspout having a through passage for conveying runoff water from its associated eavestrough to the sewer service connection of the associated roofed structure, flow restricting means in said through passage for restricting the flow of water through said through passage to a flow which is substantially less than the unrestricted flow capacity of the downspout whereby the rate at which water is conveyed to the municipal sewer drainage system in storm conditions is limited to that which the municipal sewer drainage system can accommodate from each pitched roofed structure.

PREFERRED EMBODIMENT

The invention will be more clearly understood after reference to the following detailed specification read in conjunction with the drawings wherein;

FIG. 1 diagrammatically illustrates a separate storm and sanitary drainage system according to an embodiment of the present invention;

FIG. 2 diagrammatically illustrates a combined storm and sanitary drainage system according to an embodiment of the present invention;

FIG. 3 is an exploded view of a device for restricting the rate at which water drains from an eavestrough to its associated downspout;

FIG. 4 is an assembled sectional view of the device of FIG. 1 and its associated eavestrough and downspout taken along the line 4—4 of FIG. 3.

Figure 1:
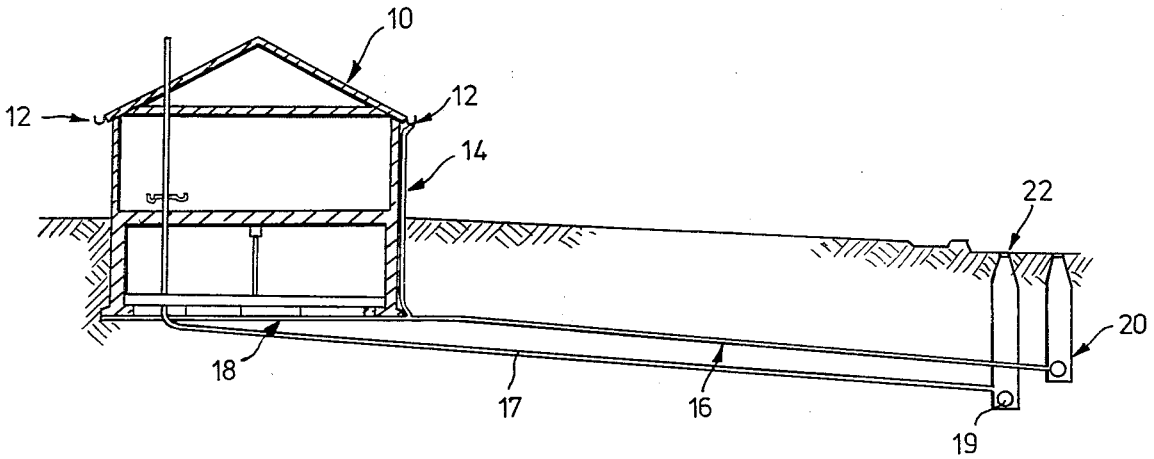

With reference to FIG. 1 of the drawings, the reference numeral 10 refers generally to a pitched roofed structure such as a house having eavestrough 12 which drain into downspouts 14. The downspouts 14 are connected under the ground to a storm sewer service connection generally identified by the reference numeral 16. The foundation drainage system 18 is also connected to the storm sewer service connection 16 which drains to the municipal storm sewer drainage system generally identified by the reference numeral 20. The internal domestic plumbing system is connected to a sanitary sewer service connection 17 which is connected to the separate sanitary sewer 19.

With reference to FIG. 1 of the drawings, it will be seen that in the event of a rain storm, rain striking the roof of the building 10 will drain into its associated eavestrough 12 and will be conveyed by downspout 14 to the storm sewer service connection 16 and will drain from the storm service connection 16 directly to the municipal storm sewer 20. Thus, it will be seen that in this conventional construction water can be very rapidly and efficiently transported from the roofed structure to the municipal storm sewer drainage system. It will also be seen that if flooding of the municipal storm sewer drainage system 20 should occur water can back up through the storm sewer service connection 16 to the foundation drain 18 and thus may be conveyed into the basement of the building if the basement floor is cracked by the hydrostatic pressure.

Figure 2:
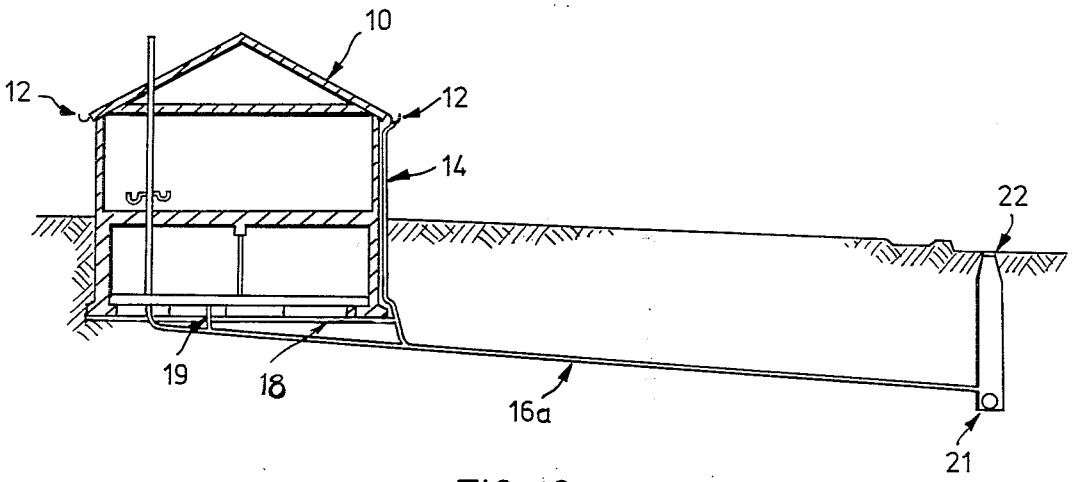

In FIG. 2 of the drawings, the like numerals apply to like parts to those in FIG. 1. FIG. 2 illustrates a system in which the sewer 21 is a combined sewer used for conveying storm water and sanitary sewage. A combined service connection **16*a* is connected to the downspouts 14, the foundation drain 18 and a basement floor drain 19** in addition to the internal domestic plumbing system of the structure.

With reference to FIG. 2 of the drawings, it will be seen that in the event of a rain storm, rain striking the pitched room of the building 10 will drain into its associated eavestrough 12 and will be conveyed by downspout 14 to the combined service connection **16*a* and will drain from the combined service connection 16*a* directly to the municipal combined sewer 21. Thus, it can be seen again that in this common construction water can be very rapidly and efficiently transported from the roof structure to the municipal combined sewer system. It will also be seen that if flooding of the municipal combined sewer system 21 should occur water can back up through the combined service connection 16*a* and through the basement floor drain 19** and flood the basement.

As previously indicated, I have discovered that there is much less likelihood of severe damage to the roofed structure by water spillage directly from the eavestrough onto the surrounding ground than there is by permitting flooding of the main municipal sewer and the result of backing up of flood waters into the basement of the building. I have found that if excess water is merely permitted to spill from the eavestrough a portion of the water will find its way to the foundation drainage system 18 while the remaining portion will drain over the surface of the ground toward surface drainage ditches or the surface of an adjacent roadway 22 or the like. In consequence while the effect of permitting overflow of the eavestroughs may be local surface flooding, it will require a considerably greater period of time to completely fill and overload the municipal storm or combined sewer 20 because of the increased time involved in transporting the excess water from the point in which it spills onto the ground until it reaches the municipal sewer. In many instances, this delay as well as infiltration of the spillage into the ground may be sufficient to prevent flooding of the storm drainage system.

I have found that a convenient mechanism for restricting the flow of water from the eavestrough is that illustrated in FIGS. 3 and 4 of the drawings which serves to restrict the input opening of the downspout.

With reference to FIGS. 3 and 4 of the drawings, the reference numeral 30 refers generally to a device for restricting the rate at which water will drain from an eavestrough into a downspout in accordance with an embodiment of the present invention. As shown in FIGS. 3 and 4, the downspout 14 has an input opening 32 communicating with the bottom of the channel profile of the eavestrough 12. The input opening 32 may be of any standard proportions which as previously indicated have been determined by conventional practices on the basis of the proportions required in order to provide for the complete draining of the eavestrough under severe storm conditions. The eavestrough 12 also has a lip portion 34 projecting inwardly from one side thereof.

The device 30 consists of cover plate 36 which has a drainage passage 38 opening therethrough. A pair of resilient legs 40 extend downwardly from the cover plate 36 and are arranged one on either side of the drainage passage 38. The legs 40 are spaced and arranged so as to fit in a close fitting relationship within the open end of the downspout 14. A resilient gasket 44 is provided which is located between the underside of the cover plate 36 and the underlying portion of the eavestrough so that substantially all of the water which is drained from the eavestrough must pass through the drainage passage 38 in order to reach the downspout 14. In order to prevent direct removal of the cover plate 36, an arm 46 is provided. The arm 46 extends upwardly from one side of the cover plate 36 and is shaped to follow the contour of the outer side wall of the eavestrough. The arm 46 has a shoulder 48 at the upper end thereof which is proportioned and arranged to underlie the lip 34 of the eavestrough to prevent the direct removal of the cover plate from its position overlying the input end 32 and to apply sufficient pressure to the top of the resilient gasket 44.

A leaf cage 50 is provided for preventing leaves and other debris blocking the drainage passage 38. The leaf cage 50 has a wire frame structure which includes a rim 52 at the lower end thereof which is engageable by hook shaped elements 54 which are mounted on the upper face of the cover plate 36. A readily visible marker cap 60 is located at the upper end of the leaf cage 50. The cap 60 is preferably made from a coloured plastic material. The leaf cage 50 is proportioned so that the readily visible cap 60 is located a substantial distance above the lip 34 of its associated eavestrough so as to be readily visible from about ground level so that inspection of the drainage system from ground level will indicate whether or not the device of the present invention are in use in any drainage system. This is important in drainage systems where the use of the restricting devices is made mandatory as this will facilitate proper policing.

Referring once more to the cover plate 36, it will be seen that the passage 38 is bounded by side walls 62 which are preferably in the form of triangular projections struck from the body of the cover plate during the forming of the drainage passage 38. The triangular projections 62 are made to extend upwardly rather than downwardly so as to provide an additional barrier for preventing an accumulation of debris directly above the drainage passage 38. It will be seen that V-shaped weir passages are provided between adjacent side walls 62 and this further serves to regulate the rate at which water is discharged to the drainage passage.

As previously indicated the device 30 is intended to substantially reduce the rate at which water enters the downspout 14. This is achieved by making the passage 38 substantially smaller than the input opening 32. I have found that the passage 38 may have a cross-sectional area within the range of 0.25 square inches up to 4 square inches with the preferred range being from 0.5 square inches up to 1 square inch. This provides a substantial reduction from the area of a conventional downspout which is generally of the order of about 7 square inches. I have found that by effecting a reduction in the area of the discharge opening of this magnitude the rate at which water is drained from the roof top to the main storm which is dramatically reduced to an extent that the likelihood of flooding of the main storm drain system is substantially reduced.

These and other advantages of the present invention will be apparent to those skilled in the art.

Various modifications of the structure of the restricting device of the present invention will be apparent without departing from the scope of the invention. Nevertheless, the arm 46 provides a significant advantage in that it makes removal of the device more difficult and it serves to apply a sealing pressure to the gasket. For example, while the leaf cage is desirable it is not essential to the successful operation of the flow restricting device.

What I claim as my invention is:

1. A storm drainage system comprising,
(a) a plurality of pitched roofed structures,
(b) a sewer service connection associated with each pitched roofed structure,
(c) a municipal sewer drainage system in direct fluid communication with said sewer service connection,
(d) an eavestrough system associated with each pitched roofed structure for collecting runoff water therefrom,
(e) at least one downspout associated with each eavestrough system, each downspout having a through passage for conveying runoff water from its associated eavestrough to the sewer service connection of the associated roofed structure,
(f) flow restricting means in said eavestrough, said flow restricting means having a drainage passage opening therethrough into said through passage of said downspout, said drainage passage having a maximum drainage capacity which is substantially less than the unrestricted flow capacity of the downspout whereby the rate at which water is conveyed to the municipal sewer drainage system in storm conditions is limited to that which the municipal sewer drainage system can accommodate from each pitched roofed structure.

2. A storm drainage system as claimed in claim 1 wherein each downspout has an input opening communicating with its associated eavestrough, said flow restricting means comprising;
(a) a cover plate proportioned to fit within said eavestrough and to extend in an overlying relationship with respect to and substantially cover said input opening of said downspout to prevent full flow discharge of water from said eavestrough to said downspout,
(b) mounting means associated with said cover plate for retaining said cover plate in an overlying relationship with respect to said input opening of said downspout in use, (c) drainage passage means opening through said cover to permit water to pass therethrough thereby to permit a restricted flow of water from said eavestrough to said downspout in use, said drainage passage having a cross-sectional area which is substantially less than that of the input opening in said downspout to restrict the maximum flow of water through said passage as aforesaid.

3. A system as claimed in claim 2 wherein said drainage passage is bounded by a plurality of side walls which project upwardly therefrom, each side wall having edges which are spaced from one another to permit water to flow therethrough into said drainage passage, said side walls acting as retaining walls to prevent a direct flow of debris to said drainage passage.

4. A system as claimed in claim 3 wherein adjacent side edges of said adjacent side walls diverge in said upward direction to form V-shaped weir passages therebetween.

5. A system as claimed in claim 2 wherein said mounting means further comprises, an arm projecting upwardly from said cover, said arm having an upper edge portion of substantial length adapted to underlie and engage an inwardly extending lip formed on said eavestrough to prevent direct withdrawal of the flow restricting means from its associated downspout.

6. A system as claimed in claim 2 including a leaf cage projecting upwardly from said cover, said leaf cage enclosing said drainage passage to inhibit the flow of debris from the eavestrough to the drainage passage.

7. A system as claimed in claim 6 wherein said leaf cage has an upper end and is proportioned such that said upper end is disposed a substantial distance above its associated eavestrough in use, a readily visible marker being mounted at the upper end of said leaf cage whereby the presence or absence of said device in a drainage system can be determined visually from a substantial distance from the eavestrough.

8. A system as claimed in claim 2 including resilient sealing means disposed between said cover plate and its underlying eavestrough.

* * * * *